United States Patent [19]

Harju

[11] Patent Number: 4,929,870

[45] Date of Patent: May 29, 1990

[54] METHOD FOR THE TRANSMISSION OF CONTROL SIGNALS TO THE ROW DRIVE CIRCUITS IN THE CONTROL OF THIN-FILM ELECTROLUMINESCENT DISPLAYS

[76] Inventor: Terho Harju, Juhonkatu 1 D 27, 08200 Lohja 20, Finland

[21] Appl. No.: 206,899

[22] Filed: Jun. 8, 1988

Related U.S. Application Data

[63] Continuation of Ser. No. 739,199, May 30, 1985, abandoned.

[30] Foreign Application Priority Data

Jun. 5, 1984 [FI] Finland ..... 842257

[51] Int. Cl.[5] ..... H01Q 19/14; G09G 3/30

[52] U.S. Cl. ..... 315/169.3; 315/169.2; 340/781; 340/776; 340/795

[58] Field of Search ..... 315/169.3, 169.2, 107; 340/781, 776, 825.81, 795, 803, 814; 250/213 A

[56] References Cited

U.S. PATENT DOCUMENTS

| | | | |
|---|---|---|---|
| 3,761,768 | 9/1973 | Schmersal | 340/776 |
| 3,842,259 | 10/1974 | Bruning | 250/213 A |
| 3,911,421 | 10/1975 | Alt et al. | 340/825.81 |
| 4,346,378 | 8/1982 | Shanks | 340/784 |

FOREIGN PATENT DOCUMENTS

| | | | |
|---|---|---|---|
| 2804924 | 8/1979 | Fed. Rep. of Germany | 340/781 |
| 0139395 | 10/1979 | Japan | 340/825.81 |

OTHER PUBLICATIONS

*Display Driver Handbook,* Texas Instruments, 1984, "The AC Thin Film Electroluminescent Display", pp. 2.42–2.49, 3.65–3.67.

*Primary Examiner*—Robert L. Griffin
*Assistant Examiner*—T. Salindong

[57] ABSTRACT

The present publication describes a method for the transmission of control signals to the row drive circuits in the control of thin-film electro-luminescent displays. According to the method, as control signals are used, a data signal, a clock signal, a signal that activates all the input stages of the row drive circuits at the same time, i.e., a strobe signal, and two signals by means of which the drive circuits controlling either odd rows or even rows are chosen to be activated (odd row enable and even row enable). According to the invention, all the control signals are transmitted via one first line (A) and one second line (B), whereby the timings of the pulses on the first line (A) and on the second line (B) are chosen so that the signal of the first line (A) is a combined odd (or even) row enable and data signal and the signal of the second line (B) is a combined even (or odd) row enable and clock signal. The strobe signal is formed by means of one logic gate out of the signals of the first line (A) and of the second line (B). By means of the invention, the testing of the row drive circuits becomes easier, because their logic part can be tested relative the system ground without switching on high voltages.

7 Claims, 1 Drawing Sheet

Figure 1A:
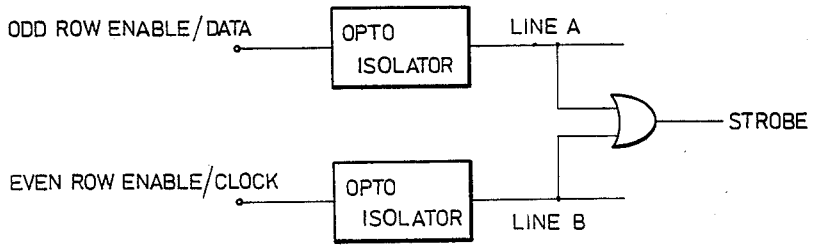

METHOD FOR THE TRANSMISSION OF CONTROL SIGNALS TO THE ROW DRIVE CIRCUITS IN THE CONTROL OF THIN-FILM ELECTROLUMINESCENT DISPLAYS

This application is a continuation of application Ser. No. 739,199 filed May 30, 1985, now abandoned.

The subject of the present invention is a method in accordance with the preamble of claim 1 for the transmission of control signals to the row drive circuits in the control of thin-film electroluminescent displays.

More specifically, the method is intended for use in connection with thin-film electroluminescent displays for transmitting the control signals to the row drive circuits, to whose ground point AC voltage is fed relative the system ground.

There are typically five control signals for row drive circuits. They are the data signal, the clock signal, the signal that activates all the input stages of the row drive circuits at the same time (strobe), and two signals by means of which the drive circuits controlling either odd rows or even rows are chosen to be activated (odd row enable and even row enable). These signals can be transmitted as such from the control electronics to the row drive circuits, e.g., by using optoisolators.

In the publication *Display Driver Handbook* 1983, Texas Instruments, it is disclosed how, by using an inverter after the optoisolators, the row enable signals can be formed out of one isolated signal. In the same publication, an AC voltage source is also disclosed, in connection with which the data signal can be formed locally. What has been reached in this way is three signals to be isolated.

In the solution in accordance with the above publication, the local generation of the data signal is based thereon that there is a positive DC voltage source and an AC voltage source whose positive amplitude is approximately equal to the voltage of the DC voltage source. However, owing to the necessity to restrict the barrier voltage of the switching transistor and of the diode and the current of the AC voltage source, the amplitude of the data signal obtained is lower than what is needed for reliable operation of the logic circuits. The requirement of a DC voltage source is a second drawback, because it restricts the planning of an AC voltage source for solutions that make use of this DC voltage source. It is a third drawback that testing of the logic part of the drive circuits is not possible without separate testing couplings unless high-voltage DC and AC voltage sources are also switched on.

The object of the present invention is to avoid the drawbacks occurring in the above prior-art technique and to provide a method of an entirely new type for reducing the number of components required for galvanic isolation.

The invention is based on the following circumstances:

1. The five control signals of the row drive circuits are transmitted via two galvanically isolated lines (A and B).
2. The timings of the pulses on the lines A and B have been chosen so that the signal of the line A is a combined odd (or even) row enable/data signal and the signal of the line B is a combined even (or odd) row enable/clock signal.
3. The strobe signal is formed by means of one logic gate out of the signals of the lines A and B.

More specifically, the method in accordance with the invention is characterized in what is stated in the characterizing part of claim 1.

By means of the invention, considerable advantages are obtained. Thus, the optoisolators are best suitable for galvanic isolation of the control signals of the row drive circuits because of their speed, size and toleration of interference. Sufficiently rapid and interference-proof optoisolators are, however, expensive, so that reducing their number is an efficient way of reducing the component costs.

Moreover, the testing of the row drive circuits becomes easier, because their logic part can be tested relative the system ground without switching on high voltages.

The invention will be examined in more detail in the following with reference to the exemplifying embodiments shown in the attached drawing.

FIG. 1*a* is a schematical illustration of one system by means of which the method in accordance with the invention can be applied.

Figure 1B:
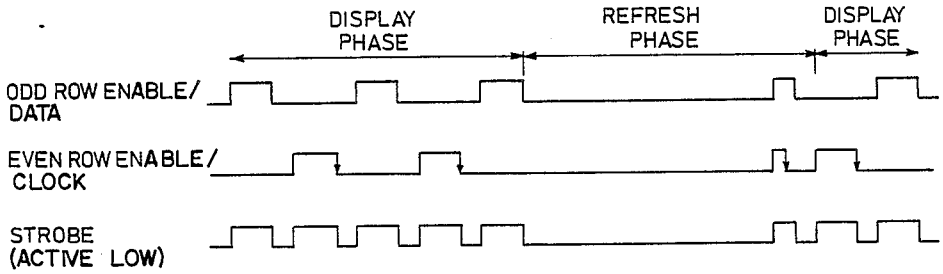

FIG. 1*b* shows the signals occurring in the system in accordance with FIG. 1*a* as a function of time.

Figure 2:
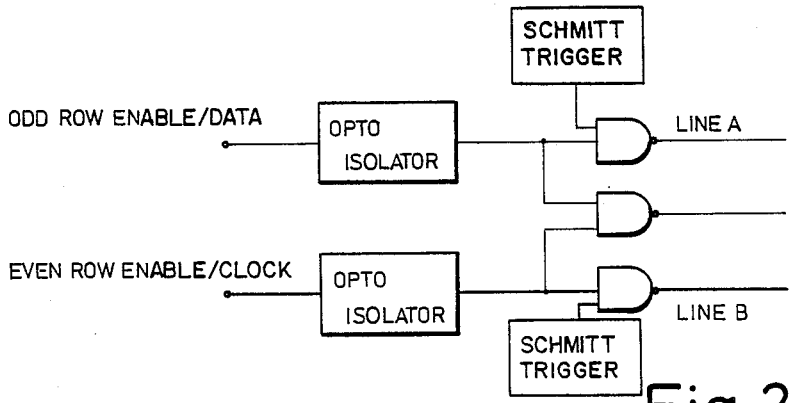

FIG. 2 is a schematical illustration of a second system by means of which the method in accordance with the invention can be applied.

Figure 2A:
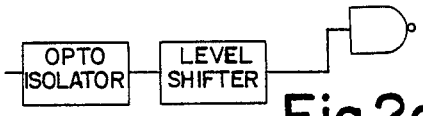

FIG. 2*a* is a schematic illustration showing an alternative wherein a level shifter is disposed between each optoisolator and the strobe gate illustrated in FIGS. 1*a* and 2.

FIG. 1*a* shows galvanic isolation of the lines A and B by means of an optoisolator, and FIG. 1*b* shows the corresponding signals odd row enable/data and even row enable/clock, as well as the strobe signal obtained out of them by means of an OR gate.

The logic part of the row drive circuits most commonly includes a shift register and gates, by means of which it is possible to permit operation of the output stages (enable-in) and to activate all of the output stages (strobe-in). In the prior-art refresh driving mode, as disclosed in the above referenced Texas Instruments publication, during the display stage, one output stage at a time is chosen to be activated, and during the refresh phase all of the output stages are switched on at the same time. From FIG. 1*b* it is seen how, during the refresh phase, a logic one is loaded into the shift register, and during the display phase logic zeros. By means of this progressive one, one output stage at a time can be chosen to be activated for the time at which the corresponding row-enable is also up. From FIG. 1*b* it is also seen that the strobe signal, which selects all of the output stages to be activated, is in the inactive state (high state) when either one of the row enable signals is active, and in the active state (low state) during the refresh phase, with the exception of a short moment at the end of the refresh phase.

Within the scope of the invention, it is also possible to conceive solutions differing from the exemplifying embodiment described above. Thus, the requirements to be imposed on the optoisolator in respect of speed may be made less strict by using a gate provided with Schmitt-trigger input after the optoisolator (FIG. 2). At the same time, the tolerance of interference is improved.

The loading of the logic one into the shift registers of the row drive circuits may also take place on the initial half of the refresh phase, because the active strobe signal is not needed until on the final half of the refresh phase, at which time the refresh pulse is going down.

For a designer in this field, it is apparent that a level shifter may be placed in each of the lines between the optoisolator and the strobe gate, as illustrated, for example, in FIG. 2*a* of the drawing.

What is claimed is:

1. A method for transmission of pulses of control signals to row drive circuits for control of thin-film electroluminescent displays, wherein the control signals include a data signal, a clock signal for clocking the data signal, a strobe signal that activates all input stages of the row drive circuits simultaneously, and two signals by means of which the drive circuits controlling odd rows and even rows are respectively chosen to be activated (odd row enable and even row enable), comprising steps of:

transmitting all of the control signals, with the exception of said strobe signal, via one first line and one second line, providing a timing of the pulses on the first line and on the second line so that the signal of the first line is a combination of both the odd (or even) row enable and the data signal, and the signal of the second line is a combination of both the even (or odd) row enable and the clock signal, and forming the strobe signal, by means of one logic gate, from the signals of the first line and of the second line, wherein the strobe signal is provided on a third line which is connected to an output of the gate.

2. A method as claimed in claim 1, wherein the step of forming the strobe signal is accomplished by means of an OR gate.

3. A method as claimed in claim 1, wherein the step of forming the strobe signal is accomplished by means of a gate provided with a Schmitt-trigger input.

4. A method as claimed in claim 1, wherein the step of forming the strobe signal is performed by connecting the first and the second lines through optoisolators having outputs, and by connecting the outputs of the optoisolators to the logic gate.

5. A method as claimed in claim 1, wherein the step of forming the strobe signal is performed by connecting the first and the second lines through level shifter circuits having outputs, and by connecting the outputs of the level shifter circuits to the logic gate.

6. A method as claimed in claim 1, wherein said first line and said second line are galvanically isolated.

7. A method as claimed in claim 1, wherein said control signals are directly connected to said row drive circuits.

* * * * *

UNITED STATES PATENT AND TRADEMARK OFFICE

CERTIFICATE OF CORRECTION

PATENT NO. : 4,929,870

DATED : May 29, 1990

INVENTOR(S) : TERHO HARJU

It is certified that error appears in the above-identified patent and that said Letters Patent is hereby corrected as shown below:

On the title page, before item [57] ABSTRACT:

Insert, --Attorney, Agent or Firm--Fitzpatrick, Cella, Harper & Scinto--.

On the title page, after item [76]:

Insert, --[73] Assignee: Oy Lohja Ab

Signed and Sealed this

Twenty-ninth Day of October, 1991

*Attest:*

HARRY F. MANBECK, JR.

*Attesting Officer*

*Commissioner of Patents and Trademarks*